US006236814B1

(12) United States Patent
Yago

(10) Patent No.: US 6,236,814 B1
(45) Date of Patent: May 22, 2001

(54) PRINTING CONTROL APPARATUS CAPABLE OF CARRYING OUT PRINTING CONTROL IN ACCORDANCE WITH A PRINTING DENSITY

(75) Inventor: Taizo Yago, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/489,193

(22) Filed: Jan. 20, 2000

(30) Foreign Application Priority Data

Jan. 21, 1999 (JP) ..... 11-012712

(51) Int. Cl.[7] ..... G03G 15/00; G03G 15/08
(52) U.S. Cl. ..... 399/27; 399/43
(58) Field of Search ..... 399/27, 30, 58, 399/61, 62, 43, 16, 23, 258, 260

(56) References Cited

U.S. PATENT DOCUMENTS 5,669,037 * 9/1997 Sugiyama ..... 399/58
5,754,916 * 5/1998 Kitayama et al. ..... 399/27

FOREIGN PATENT DOCUMENTS 63-287979 * 11/1988 (JP) .
63-287980 11/1988 (JP) .
3-171166 7/1991 (JP) .
3-185478 8/1991 (JP) .
9-138560 5/1997 (JP) .

* cited by examiner

*Primary Examiner*—Sophia S. Chen
(74) *Attorney, Agent, or Firm*—Ostrolenk, Faber, Gerb & Soffen, LLP

(57) ABSTRACT

A printing device has a developing unit 11 provided with an OPC drum for carrying out a printing, a toner feeding motor for feeding a toner into the developing unit, and a paper carrying motor for carrying paper to the OPC drum. A toner quantity detecting sensor detects a toner quantity in the developing unit every page as a detected toner quantity and supplies the detected toner quantity as a detected voltage to a control section. When a difference voltage between a predetermined reference voltage and the detected voltage is greater than a predetermined threshold level, the control section selectively stops the paper carrying motor during a stopping time duration determined on the basis of the detected voltage. Furthermore, the control section selectively drives the toner feeding motor during a driving time duration determined in accordance with the detected voltage.

24 Claims, 6 Drawing Sheets

| DIFFERENCE VOLTAGE | FEEDING MOTOR TIME | CARRYING MOTOR STOPPING TIME |
|---|---|---|
| $V_0$ | 200ms | 0s |
| $V_1$ | 250ms | 0s |
| $V_2$ | 300ms | 0s |
| $V_3$ | 350ms | 0s |
| $V_4$ | 400ms | 0s |
| · | · | · |
| · | · | · |
| · | · | · |
| · | · | · |
| $V_A$ | 10s | 8s |
| $V_B$ | 15s | 13s |

FIG. 3

| DIFFERENCE VOLTAGE | FEEDING MOTOR TIME | CARRYING MOTOR STOPPING TIME |
|---|---|---|
| $V_0$ | 200ms | 0s |
| $V_1$ | 300ms | 0s |
| $V_2$ | 400ms | 0s |
| $V_3$ | 500ms | 0s |
| $V_4$ | 600ms | 0s |
| • | • | • |
| • | • | • |
| $V_A$ | 20s | 17s |
| $V_B$ | 30s | 27s |

FIG. 6

PRINTING CONTROL APPARATUS CAPABLE OF CARRYING OUT PRINTING CONTROL IN ACCORDANCE WITH A PRINTING DENSITY

BACKGROUND OF THE INVENTION

This invention relates to a printing control apparatus, and more particularly, to a printing control apparatus capable of carrying out printing with high density printing.

In general, it is necessary for a printing device to use much toner when the printing device carries out a printing with a high density. When the quantity of the toner coming out of a developing unit becomes greater than the quantity of the toner which is fed into the developing unit, the printing result gradually becomes thin.

The developing unit has a restriction in the maximum printing density when the printing device carries out a continuous printing. A conventional printing device does not control the printing density on the continuous printing. The conventional printing device carries out the continuous printing in no concern with the printing density. As a result, the printing result gradually becomes thin in the conventional printing device.

SUMMARY OF THE INVENTION

It is therefore an object of this invention to provide a printing control apparatus capable of carrying out a printing control in accordance with a printing density.

Other objects of this invention will becomes clear as the description proceeds.

On the describing the gist of this invention, it is possible to understand that a printing control apparatus controls a printing device comprising a developing unit provided with a printing drum for carrying out a printing, toner feeding means for feeding a toner into the developing unit, and a carrying motor for carrying a paper to the printing drum. According to this invention, the printing control apparatus comprises detecting means for detecting a toner quantity in the developing unit to produce a detected toner quantity and control means for controlling the carrying motor to stop the carrying motor during a predetermined stop time duration in accordance with the detected toner quantity when the detected toner quantity is less than a predetermined toner quantity, the control means controlling the toner feeding means to drive the toner feeding means during a predetermined driving time duration in accordance with the detected toner quantity when the detected toner quantity is less than the predetermined toner quantity.

BRIEF DESCRIPTION OF THE DRAWINGS

FIG. 3 is a table provided in a control section illustrated in FIG. 2;

FIG. 6 is a table provided in a control section illustrated in FIG. 5.

DESCRIPTION OF THE PREFERRED EMBODIMENT

Figure 1:
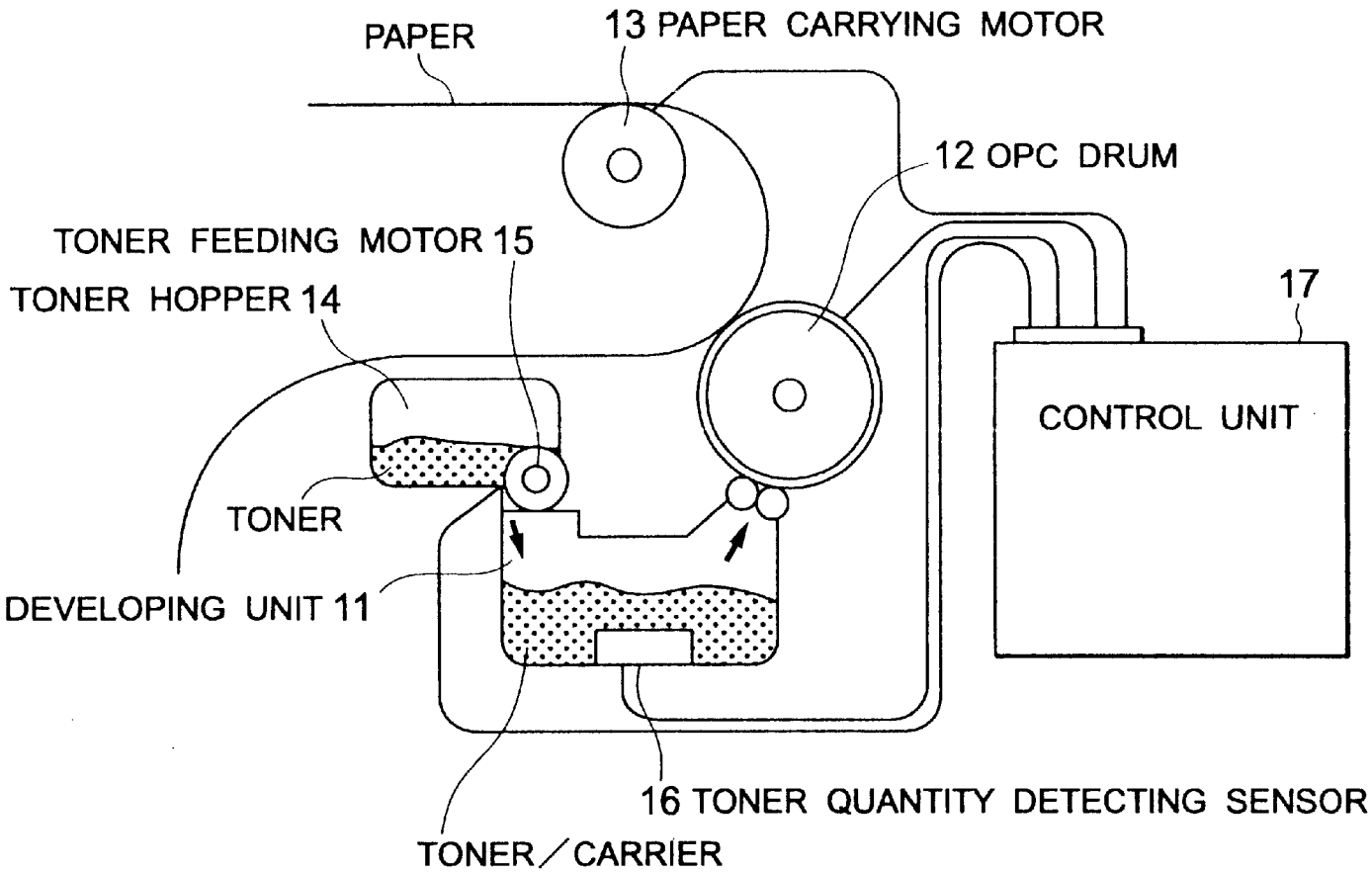
FIG. 1 PRIOR ART
FIG. 1 is a block diagram of a conventional printing control apparatus.

Referring to FIG. 1, a conventional printing control apparatus will be described at first in order to facilitate an understanding of this invention. A conventional printing device comprises a developing unit 11, an organic photoconductor (OPC) drum 12, a paper carrying motor 13, a toner hopper 14, and a toner feeding motor 15. A toner quantity detecting sensor 16 is located in the developing unit 11. A control section 17 controls the OPC drum 12, the paper carrying motor 13, and the toner feeding motor 15 as will be described later.

When a printing start signal is given to the control section 17, the control section 17 makes the OPC drum 12 rotate in order to drive the developing unit 11. Furthermore the control section 17 drives the paper carrying motor 13.

A toner and a carrier are contained in the developing unit 11. The toner is transferred to the OPC drum 12 because of the electric potential difference of the OPC drum 12. When the developing unit 11 transfers the toner-to the OPC drum 12, the toner level is reduced in the developing unit 11. As a result, a quantity ratio of toner/carrier varies. This varied quantity is detected by the toner quantity detecting sensor 16 to be outputted as a detected voltage. When the detected voltage is supplied to the control section 17, the control section 17 calculates a difference voltage between the detected voltage and a predetermined reference voltage which is representative of a reference ratio of the quantity ratio of toner/carrier. The control section 17 controls the toner feeding motor 15 to rotate in accordance with the difference voltage.

When the toner feeding motor 15 is driven, the toner stored in the toner hopper 14 is supplied to the developing unit 11. When the toner is fed into the developing unit 11 and the detected voltage equals to the predetermined reference voltage, the control section 17 stops rotation of the toner feeding motor 15. In a manner described above, the quantity ratio of toner/carrier is kept constant so that a stable printing consistency result is obtained.

When a printing density is high, the quantity of the toner used per a page is great, and a great quantity of toner must be supplied from the developing unit 11 to the OPC drum 12. When the quantity of the toner coming out of the developing unit 11 becomes greater than that of the toner fed into the developing unit 11, the printing result gradually becomes thin.

The developing unit 11 has a restriction in the maximum printing density on being continuously printed. However, the conventional printing device carries the continuous printing without concern for the printing density. Inasmuch as the conventional printing device does not control the printing density on the continuous printing, the printing result gradually becomes thin.

Figure 2:
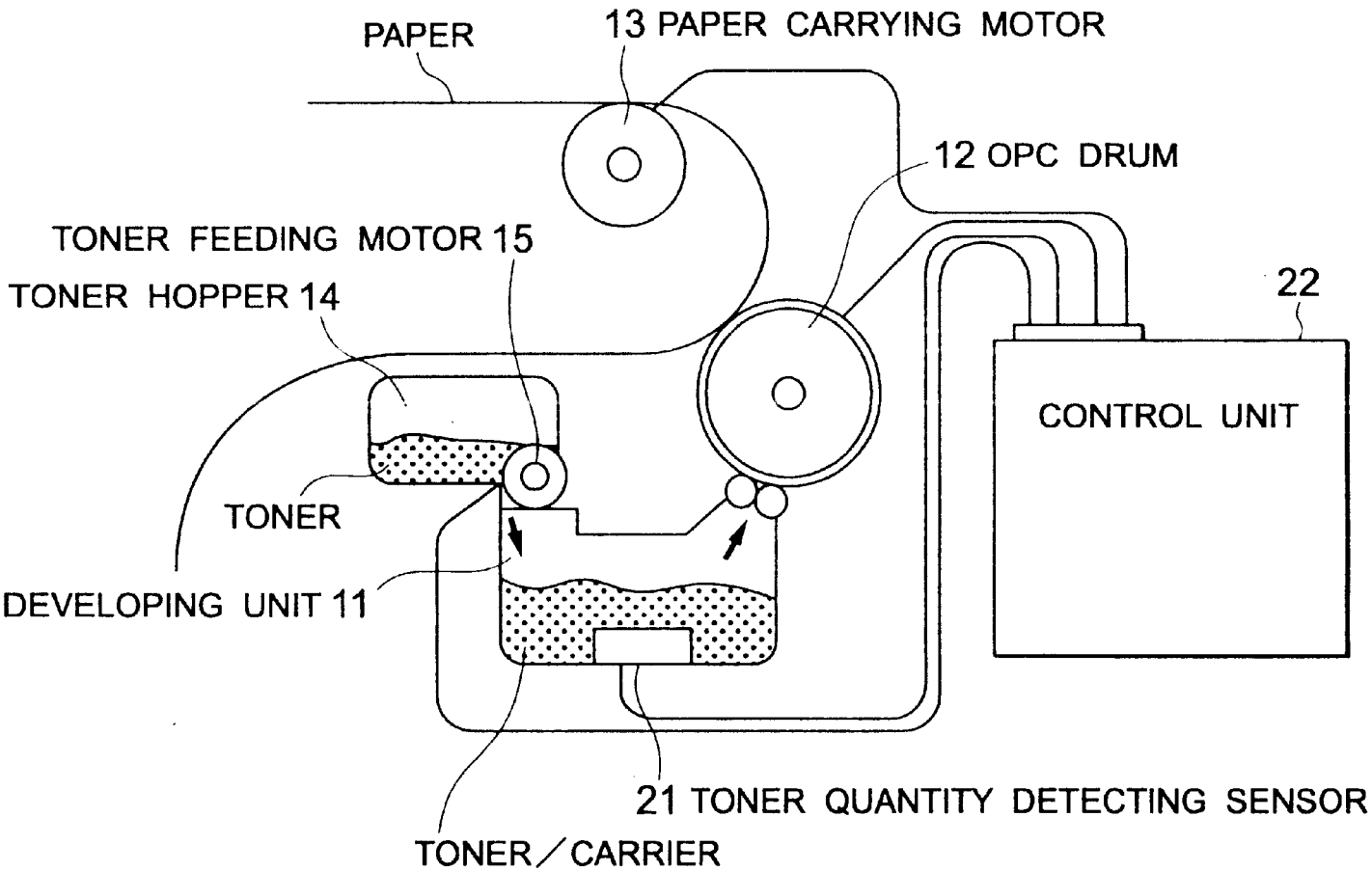
FIG. 2 is a block diagram of a printing control apparatus according to a first embodiment of this invention.

Referring to FIG. 2, description will proceed to a printing control apparatus according to a first embodiment of this invention. The illustrated printing device comprises similar parts which are designated by like reference numerals. The printing device comprises the developing unit 11, the organic photoconductor (OPC) drum 12, the paper carrying motor 13, the toner hopper 14, and the toner feeding motor 15. A toner quantity detecting sensor 21 is located in the developing unit 11. A control unit 22 controls the OPC motor 12, the paper carrying motor 13, and the toner feeding motor 14 as will be described later.

During a printing operation, control section 22 makes the OPC drum 12 rotate in order to drive the developing unit 11. Furthermore the control unit 22 drives the paper carrying motor 13.

A toner and a carrier are contained in the developing unit 11. The developing unit 11 transfers the toner to the OPC drum 12 in compliance with a potential difference of the OPC drum 12. When the developing unit 11 supplies the toner to the OPC drum 12, the quantity of toner in the developing unit 11 is reduced. As a result, a quantity ratio of toner/carrier varies. This varied raito is detected by the toner quantity detecting sensor 21 to be outputted as a detected voltage. The detected voltage is supplied as a detected page voltage to the control section 22 for every printed page.

The control section 22 calculates a difference voltage between a predetermined reference voltage and the detected page voltage to produce the difference voltage as a difference page voltage. When the difference page voltage is not greater than a predetermined threshold level, the control section 22 controls the paper carrying motor 13 in order to carry a usual continuous printing. When the difference page voltage is greater than the predetermined threshold level, the control section 22 stops the paper carrying motor 13 in accordance with the difference page voltage and makes toner feeding motor 15 rotate until the detected page voltage reaches the predetermined reference voltage. When the detected page voltage reaches the predetermined reference voltage, the control section 22 drives the paper carrying motor 13 again in order to restart the printing.

Figure 4:
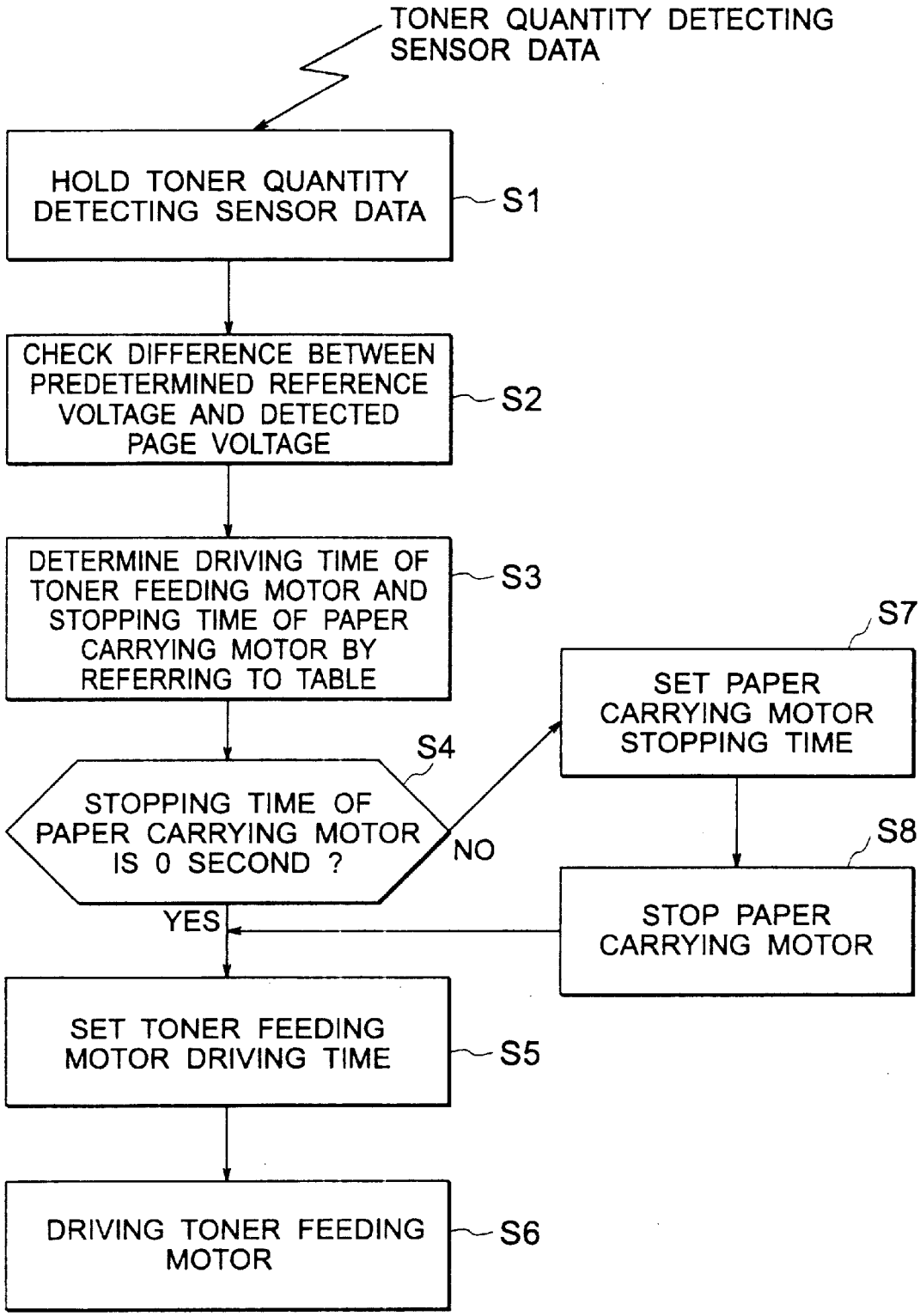
FIG. 4 is a flowchart for describing an operation of the control section illustrated in FIG. 2.

Referring to FIGS. 3 and 4 in addition to FIG. 2, the control section 22 is provided with a table illustrated in FIG. 3. The control section 22 controls the paper carrying motor 13 and the toner feeding motor 15 in compliance with the table illustrated in FIG. 3. The table has a matrix form composed of the driving time of the toner feeding motor and the stopping time of the paper carrying motor in correspondence to the detected page voltage. The table may be stored in a memory of the control section 22. When the driving time of the toner feeding motor 15 is less than the printing time of one page, the carrying motor stopping time is equal to zero inasmuch as it is unnecessary to stop the paper carrying motor 13. When the driving time of the toner feeding motor 15 requires a time exceeding the one page printing time, the paper carrying motor 13 is stopped for a time as long as required in order to feed sufficient quantity of toner to the developing unit 11.

As shown in FIG. 3, the driving time of the feeding motor (feeding motor time) becomes 250 ms and the carrying motor stopping time becomes 0 s in case where the difference page voltage is equal to V1. In case where the difference page voltage is equal to VA, the feeding motor time becomes 10 s, and the carrying motor stopping time becomes 8 s.

The toner quantity detecting sensor 21 detects the toner quantity in the developing unit 11 every page during the printing to supply a detected page voltage to the control section 22. When the detected page voltage is given from the toner quantity detecting sensor 21 to the control section 22 as toner quantity detecting sensor data, the control section 22 stores or holds the toner quantity detecting sensor data therein (step S1). More particularly, the control section 22 stores the toner quantity detecting sensor data in an internal memory.

The control section 22 checks the difference between the predetermined reference voltage and the detected page voltage (step S2) to produce the difference page voltage which is memorized in the internal memory. The control section 22 refers to the table illustrated in FIG. 3 in accordance with the difference page voltage to determine the driving time duration of the toner feeding motor 15 and the stopping time duration of the paper carrying motor 13 (step S3).

The control section 22 judges whether or not the stopping time duration of the paper carrying motor 13 is equal to 0 second (0s) (step S4). When the stopping time duration of the paper carrying motor 13 is equal to 0 second, the control section 22 sets the toner feeding motor driving time duration corresponding to the difference page voltage (step S5). The control section 22 starts driving of the toner feeding motor 15 (step S6).

When the stopping time duration of the paper carrying motor 13 is not equal to 0 second in the step S4, the control section 22 sets a paper carrying motor stopping time duration corresponding to the difference page voltage (step S7). The control section 22 starts the driving of the paper carrying motor 13 (step S8). Thereafter, the control section 22 implements the steps S5 and S6.

As described above, the printing device implements the continuous printing in case where the continuous printing is carried out below the maximum printing density. When printing is carried out beyond the maximum printing density, the toner quantity in the developing unit 11 greatly reduces. As a result, the difference page voltage becomes great. When the difference page voltage becomes great, the control section 22 refers to the table to determine the printing stopping time duration as described above. The control section 22 stops the paper carrying motor 13 in accordance to the printing stopping time duration. The control section 22 makes the toner feeding motor 15 rotate while the paper carrying motor 13 is being stopped. As a result, the toner is continuously fed into the developing unit 11. Although the printing speed somewhat decreases, no restriction is exerted on the printing density. A stable print consistency is obtained.

Figure 5:
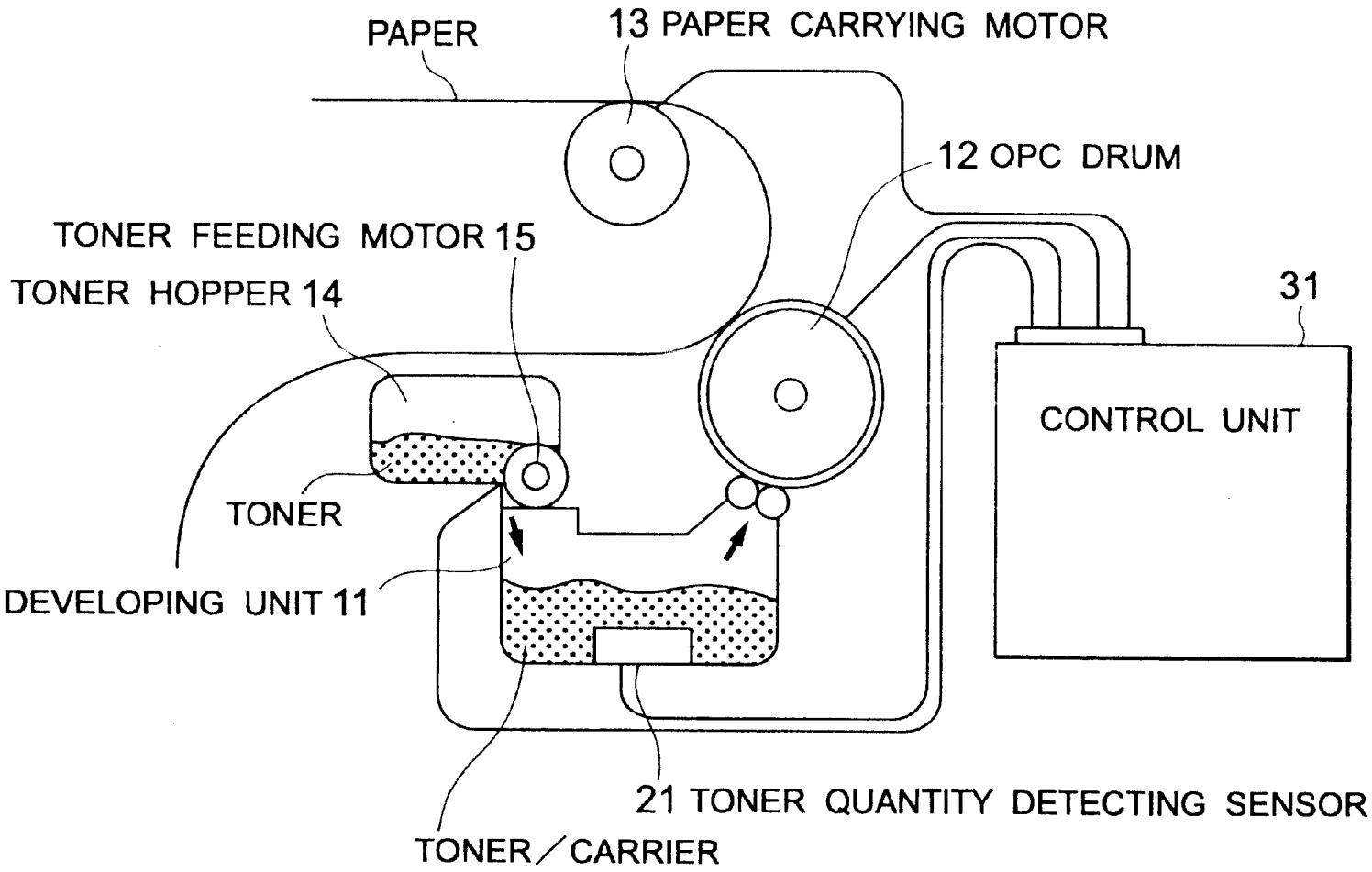
FIG. 5 is a block diagram of a printing control apparatus according to a second embodiment of this invention.

Referring to FIGS. 5 and 6, description will proceed to a printing control apparatus according to a second embodiment of this invention.

The illustrated printing control apparatus comprises similar parts which are designated by like reference numerals. When a control section 31 receives the printing start signal, the control section 31 makes the OPC drum 12 rotate in order to drive the developing unit 11. Furthermore the control section 31 drives the paper carrying motor 13.

As described above, the toner and the carrier are contained in the developing unit 11. The developing unit 11 transfers the toner to the OPC drum 12 because of the potential difference of the OPC drum 12. When the developing unit 11 transfers the toner to the OPC drum 12, the toner decreases in the developing unit 11. As a result, a quantity ratio of toner/carrier varies. The toner quantity detecting sensor 21 outputs the detected voltage corresponding to the variation of the toner. The toner quantity detecting sensor 21 supplies the detected voltage as the detected page voltage to the control section 31 every page. The control section 31 calculates the difference page voltage between the predetermined reference voltage and the detected page voltage.

The control section 31 may be provided with the table illustrated in FIG. 6. The control section refers to the table to determine the toner feeding motor time duration and the paper carrying motor stopping time duration. The table illustrated in FIG. 6 is a table in case where the developing unit has a low printing density performance. The table illustrated in FIG. 6 has the toner feeding time and the paper stopping time which are longer in comparison with those of the table illustrated in FIG. 3. In the table shown in FIG. 6, the feeding motor time becomes 300 ms and the carrying motor stopping time becomes Os in case where the difference page voltage is equal to VI. In case where the difference page voltage is equal to VA, the feeding motor time becomes 20 s and the carrying motor stopping time becomes 17 s.

As described above, the control section 31 carries out the continuous printing as usual in case where the difference page voltage is not greater than the predetermined threshold level. When the difference page voltage is greater than the predetermined threshold level, the control section stops the paper carrying motor 13 in accordance with the difference page voltage. The control section 31 makes the toner feeding motor 15 rotate until the detected page voltage reaches the predetermined reference voltage. When the detected page voltage reaches the predetermined reference voltage, the control section 31 makes the paper carrying motor 13 rotate again to restart the printing.

In case where the developing unit 11 has the low printing density performance, it is possible to obtain the stable print consistency by using the table illustrated in FIG. 6.

As described above, it is possible to carry out a printing with a high density in no concern with the developing unit 11 inasmuch as the printing is selectively stopped and the toner is fed into the developing unit in accordance with the toner quantity in the developing unit 11.

While this invention has thus far been described in conjunction with the preferred embodiment thereof, it will readily be possible for those skilled in the art to put this invention into practice in various other manner.

What is claimed is:

1. A printing density controller for a printing device including a developing unit, a printing drum, a toner feeding unit for supplying toner to the developing unit and a drive unit including a paper carrying motor that delivers paper to the printing drum, the printing density controller being comprised of:

a detecting device that provides a signal voltage representative of the quantity of toner in the developing unit; and a control section responsive to the toner quantity signal voltage, and which operates the toner feeding unit for a first time interval in accordance with the toner quantity signal voltage when the quantity of toner detected in the developing unit is less than a first predetermined amount;

the control section further being operative to selectively stop the paper carrying motor for a second time interval in accordance with the toner quantity signal voltage when the quantity of toner detected in the developing unit is less than a second predetermined amount, the second time interval being shorter than the first time interval, and the second predetermined amount being less than the first predetermined amount.

2. A printing density controller as claimed in claim 1 wherein the voltage of the toner quantity signal is representative of the detected toner quantity.

3. A printing density controller as claimed in claim 1, wherein the control section is operative:

to calculate a difference voltage between the voltage of the toner quantity signal and a reference voltage;

to operate the toner feeding unit during the first time interval in accordance with the voltage of the toner quantity signal when the difference voltage is greater than a first predetermined threshold level corresponding to the first predetermined amount; and to stop the paper carrying motor for the second time interval in accordance with the voltage of the toner quantity signal when the difference voltage is greater than a second predetermined threshold level corresponding to the second predetermined amount.

4. A printing density controller as claimed in claim 3, wherein the control section includes a table having entries defining a plurality of carrying motor stop time intervals and feed motor driving time intervals for different values of the difference voltage.

5. A printing density controller as claimed in claim 4, wherein the entries in the table are determined in accordance with a printing density performance of the developing unit.

6. A printing density controller as claimed in claim 5, wherein a stop time interval is specified in the table only for difference voltages corresponding to toner quantity levels which would not provide acceptable print density if printing were permitted during the feed motor driving time interval corresponding to those toner quantity levels.

7. A printing density controller as claimed in claim 4, wherein the control section stops the paper carrying motor during a stop time interval corresponding to a difference voltage only when the difference voltage is greater than the second threshold level.

8. A printing density controller as claimed in claim 7, wherein the entries in the table are determined in accordance with a printing density performance of the developing unit.

9. A printing density controller as claimed in claim 4, wherein a stop time interval is specified in the table only for difference voltages corresponding to toner quantity levels which would not provide acceptable print density if printing were permitted during the feed motor driving time interval corresponding to those toner quantity levels.

10. A printing density controller as claimed in claim 3 wherein the control section is operative to perform the difference voltage calculation on a page by page basis.

11. A printing control apparatus for use in controlling a printing device comprising a printing drum, a developing unit, a toner feeding unit for supplying toner into said developing unit and a carrying motor for carrying printing paper to said printing drum, said printing control apparatus being comprised of:

a detecting device that detects a quantity of toner in said developing unit and produces a toner quantity signal voltage; and a control unit operative to stop said carrying motor for a predetermined stop time interval in accordance with said toner quantity signal when said detected toner quantity is less than a predetermined amount, said control unit being further operative to drive said toner feeding unit for a predetermined driving time interval in accordance with said toner quantity signal when said detected toner quantity is less than said predetermined amount;

the voltage of said toner quantity signal being representative of the quantity of toner detected in said developing unit;

said control unit being operative to calculate a difference voltage between the voltage of said toner quantity signal and a predetermined reference voltage, to stop said carrying motor during said predetermined stop time interval in accordance with said toner quantity signal voltage when said difference voltage is greater than a predetermined threshold level, and to drive said toner feeding unit during said predetermined driving time interval in accordance with said toner quantity signal voltage when said difference voltage is greater than said predetermined threshold level;

said control unit including a table defining a plurality of carrying motor stop time intervals and feed motor driving time intervals for different values of said difference voltage.

12. A printing control apparatus as claimed in claim 11, wherein said table is determined in accordance with a printing density performance of said developing unit.

13. A printing control apparatus as claimed in claim 11, wherein said control unit refers to said table to drive said toner feeding unit during said predetermined driving time interval corresponding said difference voltage when said difference voltage is not greater than said predetermined threshold level.

14. A printing control apparatus as claimed in claim 13, wherein said table is determined in accordance with a printing density performance of said developing unit.

15. A method of controlling the printing density of a printing device including a developing unit, a printing drum, a toner feeding unit for supplying toner to the developing unit and a drive unit including a motor for carrying paper to the printing drum, the method being comprised of:

detecting a quantity of toner in the developing unit;

operating the toner feeding unit for a first time interval in accordance with the quantity of toner detected in the developing unit when the quantity of toner detected is less than a first predetermined amount; and selectively stopping the paper carrying motor for a second time interval in accordance with the quantity of toner detected in the developing unit when the quantity of toner detected is less than a second predetermined amount, the second time interval being shorter than the first time interval, and the second predetermined amount being less than the first predetermined amount.

16. A method as claimed in claim 15, further including the step of generating a voltage representative of the detected toner quantity.

17. A method as claimed in claim 16, further including the steps of:

calculating a difference voltage between the voltage representative of the toner quantity and a reference voltage;

operating the toner feeding unit during the first time interval in accordance with the voltage of the detected toner quantity when the difference voltage is greater than a first predetermined threshold level corresponding to the first predetermined amount; and stopping the paper carrying motor for the second time interval in accordance with the voltage representative of the toner quantity when the difference voltage is greater than a second predetermined threshold level corresponding to the second predetermined amount.

18. A method as claimed in claim 17, further including the step of referring to a table having entries defining a plurality of carrying motor stop time intervals and feed motor driving time intervals for different values of the difference voltage to determine a carrying motor stop time interval and a feed motor driving time interval for a particular difference voltage.

19. A method as claimed in claim 18, wherein the entries in the table are determined in accordance with a printing density performance of the developing unit.

20. A method as claimed in claim 18, further including the step of stopping the paper carrying motor during a stop time interval corresponding to a difference voltage only when the difference voltage is greater than the second threshold level.

21. A method as claimed in claim 20, wherein the entries in the table are determined in accordance with a printing density performance of the developing unit.

22. A method as claimed in claim 21, wherein a stop time interval is specified in the table only for difference voltages corresponding quantity levels which would not provide acceptable print density if printing were permitted during the feed motor driving time interval corresponding to those toner quantity levels.

23. A method as claimed in claim 18, wherein a stop time interval is specified in the table only for difference voltages corresponding to toner quantity levels which would not provide acceptable print density if printing were permitted during the feed motor driving time interval corresponding to those toner quantity levels.

24. A method as claimed in claim 17, wherein the difference voltage calculation is performed on a page by page basis.

* * * * *